United States Patent [19]

Koontz et al.

[11] 4,071,417

[45] Jan. 31, 1978

[54] PROCESS FOR DECREASING THE POROSITY OF GOLD

[75] Inventors: Donald Eldridge Koontz, Summit; Peter Kenny Skurkiss, Short Hills, both of N.J.

[73] Assignee: Bell Telephone Laboratories, Incorporated, Murray Hill, N.J.

[21] Appl. No.: 811,039

[22] Filed: June 29, 1977

[51] Int. Cl.[2] ..... C25D 5/48; C25D 11/38

[52] U.S. Cl. ..... 204/38 B; 204/38 R; 204/40; 204/140

[58] Field of Search ..... 204/38 R, 38 B, 40, 204/140

[56] References Cited

U.S. PATENT DOCUMENTS

| | | | |
|---|---|---|---|
| 3,625,844 | 12/1971 | McKean | 204/140 |
| 3,632,389 | 1/1972 | Vazirani | 117/49 |
| 3,700,469 | 10/1972 | Okinaka | 106/1 |

OTHER PUBLICATIONS

Journal of Electrochemical Society, vol. 120, No. 6, June 1973, p. 735.

Protective Coatings for Metals, Third Edition; American Chemical Society, Monograph Series No. 163; Reinhold, 1967, pp. 27–54.

Reid and Goldie, Gold Plating Technology, Electrochemical Publications Limited, 1974, pp. 21–52.

Lowenheim, Modern Electroplating, Wiley, 1963, pp. 224–244, Metal Finishing, Sept. 1975, p. 29.

*Primary Examiner*—G. L. Kaplan
*Assistant Examiner*—William Leader
*Attorney, Agent, or Firm*—Walter G. Nilsen

[57] ABSTRACT

A process is described for making modified gold platings of low porosity. This process involves first putting down a gold layer and then passivating this layer using an electrochemical chromating procedure. This process permits use of much thinner gold layers than ordinarily used without the danger of corrosion of underlying base metal.

15 Claims, 2 Drawing Figures

PROCESS FOR DECREASING THE POROSITY OF GOLD

BACKGROUND OF THE INVENTION

1. Field of the Invention

The invention relates to a process for producing gold layers.

2. Description of the Prior Art

Gold layers are extensively used for many industrial applications including production of jewelry, ornamental articles, optical devices as well as in the fabrication of electronic circuits and components.

In recent years the use of gold in such industrial applications has been increasing very rapidly. Gold platings are very attractive and extensively used for decorative purposes particularly in the jewelry and related industries. Gold platings are also extensively used in the manufacture of electronic devices and components due to their good electrical conduction properties and good electrical contact properties as well as gold's freedom from corrosion. Because of extensive and increasing use and the high cost of gold it is highly desirable to minimize the amount of gold used in various articles and devices without substantially detracting from article appearance and device performance.

For example, in many applications both for decorative purposes and in electrical devices minimum gold layer thicknesses are dictated by anticorrosion requirements rather than appearance or electrical requirements. Gold films are often made thick enough so as to minimize porosity and therefore protect the underlying metal against corrosion. Thus, to save gold, it is highly desirable to develop a procedure for limiting the porosity of gold layers so that less gold might be used.

SUMMARY OF THE INVENTION

The invention is a procedure for producing a protective layer on metallic surfaces or base metals in which the protective layer is made largely of gold. This procedure results in a gold layer of low porosity. Generally, the gold layer contains at least 90 percent by weight gold. Indeed, the gold content of many gold layers exceed 98 or even 99 weight percent. The base metal or metallic surfaces may be solid metal or a layer produced, for example by a plating procedure. The process is particularly useful for base metals such as copper, nickel, tin, zinc and iron, alloys of these metals with each other and other metals. Generally, the alloys with other metals contain at least 50 percent by weight of copper, nickel, tin, iron and zinc. Included are base metals and base alloys which are themselves plated on a surface. The procedure involves subjecting a gold layer to a chromating procedure. Generally, the chromating procedure including electrolytic solution should be capable of depositing chromium chemically combined with oxygen on the metallic surface or base metal. Although a variety of chromating procedures may be used, best results in terms of low porosity are obtained by use of a particular procedure in which the chromating solution contains, in addition to a source of chromium, also ammonium ions. This procedure leads to a gold film which despite its small thickness has low porosity which will not corrode over a long period of time. This results in articles and devices with expected long life despite minimum use of gold.

DETAILED DESCRIPTION

1. The Gold Layer

Figure 1:
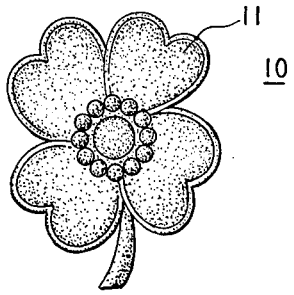
FIG. 1 is a top view of a piece of jewelry with the modified gold layer made in accordance with the invention.

The gold layer may be produced by a variety of methods including electroplating, electroless plating, vacuum deposition, etc. Gold electrodeposition is well known and is described in a variety of references including "Gold Plating Technology" by F. H. Reid and W. Goldie, *Electrochemical Publications Limited,* 1974, and *Modern Electroplating* edited by F. W. Lowenheim, 2nd edition, Wiley, New York, 1963.

Some typical compositions for electroplating solutions are given below. These electroplating procedures may be carried out at various temperatures between the freezing point and boiling point of the solution. Preferred temperatures are given for some examples.

| | | |
|---|---|---|
| 1. Hard Gold | | |
| Potassium gold cyanide KAu $(CN)_2$ | 12–46 gm/l | |
| Citric acid anhydrous | 80–120 | gm/l |
| KOH | 4–6 | gm/l |
| Cobalt citrate | 100–200 | ppm |
| 2. Hard Gold | | |
| Potassium gold cyanide | 12–46 | gm/l |
| Phosphoric acid to adjust pH to approximately 4.2 | | |
| Cobalt citrate | 100–200 | ppm |
| 3. Soft Gold | | |
| Potassium gold cyanide | 12–46 | gm/l |
| Potassium hydrogen phosphate | 40 | gm/l |
| Potassium dihydrogen phosphate | 10 | gm/l |
| This yields a solution with pH approximately 7.0 and plating should be carried out at a temperature of approximately 65 degrees C. | | |
| 4. Soft Gold | | |
| Potassium gold cyanide | 20 | gm/l |
| $(NH_4)_2 HC_6H_5O_7$ | | |
| pH 5 – 6.5 plating temperature approximately 65 degrees C. | | |

Electroless gold deposition may also be used to produce the gold layer. Included in such electroless deposition are gold displacement procedures as well as catalytic plating procedures and truly autocatalytic gold plating procedures. Many such procedures have been described in Chapter 11 of the Reid and Goldie reference cited above. Electroless gold plating procedure and bath composition are described in U.S. Pat. No. 3,700,469 issued on Oct. 24, 1972 to Yutaka Okinaka.

Another procedure for producing gold films is vacuum evaporation of gold. These procedures are also well known and have been described extensively in the literature. Inlay gold may also be used to provide the gold layer. This method uses a gold sheet or ribbon, often very thin, which is bonded to an undersurface, usually of metal.

In some cases, the procedure is most beneficial when the gold layer is quite thin, for example, less than 500 microinches or in some cases even less than 150 microinches. The reason for this is that porosity increases dramatically with reduced thickness and the need for passivation becomes greater for very thin gold layers.

In the range from 50 to 150 microinches careful plating often reduces porosity but under manufacturing conditions, porosity is often a problem. Below 50 microinches, porosity is almost always a problem. Although very thin gold platings (1–10 microinches or even below one microinch) present severe porosity problems, such platings are often easily and cheaply produced say by electroless plating or displacement plating and are often satisfactory from an electrical (and other) standpoint provided corrosion can be prevented. For this reason, extremely thin gold platings are often preferred.

2. The Chromating Procedure

After production of the gold layer, it is subjected to a chromating procedure involving an electrolytic deposition procedure. Conventional procedures well known in the art of producing chromate films may be used. Such procedures are described in a variety of references including "Chromate Conversion Coatings" by F. W. Eppensteiner and M. R. Jenkins in *Metal Finishing,* Sept. 1975, page 29; "A Study of Surface Chromium on Tinplate" by S. E. Rauch, Jr. and R. N. Steinbicker, in *Journal of Electrochemical Society,* Vol. 120, No. 6, June 1973, page 735; and U.S. Pat. No. 3,625,844 issued to Walter A. McKean. Chromating procedures are also described by H. N. Vazirani in U.S. Pat. No. 3,632,389, issued Apr. 3, 1968. The chromating procedure may be carried out cathodically, anodically or without electrolytic action. Cathodic chromating yields the best results in terms of the severity of the test for pores in the gold plating. Various solutions may be used provided they contain a source of chromate. Generally, a dichromate solution is used (e.g., potassium or sodium dichromate). The concentration may vary over wide ranges (e.g., 1 gm/liter to saturation) but 1–10 gms. per liter potassium dichromate (or equivalent chromate concentration) yields convenient chromating rates without being wasteful of materials. Solution temperature may vary from freezing to boiling temperatures but room temperature is most convenient. Often, higher temperatures (generally 45°–95° C) yield better results in terms of better films (more resistant to pore formation), shorter time or current requirements but this advantage is often offset by the inconvenience of operating at elevated temperatures. Various anodes may be used including lead anodes and platinized titanium anodes.

Current and time requirements may vary over large values. Typical is a current of 50–800 amperes per square foot (ASF) and times of 3 seconds to 90 minutes but current densities and times outside these ranges are often useful. Generally, shorter times are more often used with higher current densities but even short times with low current densities are useful for many applications.

The small currents together with short times yield much less protection than longer times with higher currents. Times greater than 90 minutes may be used but does not generally increase corrosion protection.

Although the exact mechanism by which porosity is decreased by this procedure is not known, it is believed that chromate film is deposited on the base metal through the pores in the gold. This chromate film, exclusive of base metal diffused into the film, is believed to consist of at least 90 percent by weight of chromium and oxygen chemically combined with one another.

A typical procedure is now described. The gold plating is first surface cleaned if required. Typically, the surface is vapor degreased with trichloroethylene for 5 minutes, air dried and immersed in an alkaline cleaner at approximately 65° C for 4 minutes. The material is then rinsed in water and acid cleaned for 3 minutes. The material surface is then rinsed in water and dried with nitrogen gas. A more complete description of cleaning and degreasing methods may be found in the literature; see for example *Protective Coatings for Metals,* Third Edition, American Chemical Society, Monograph 163 by R. M. Burns and W. W. Bradley, pages 27 to 54, Reinhold (1967). The chromate film is cathodically deposited using a 5 weight percent potassium dichromate solution (pH approximately 3.7) at room temperature. The current density is approximately 90 ASF and the time of electrolysis is approximately 3 to 15 minutes.

The process for reducing the porosity of gold layers is greatly improved by the addition of ammonium ion to the chromating solution. Even quite small amounts of ammonium ions (0.005 molar) are effective in the practice of the invention. However, the concentration range between 0.1 molar and saturation is preferred because the greater concentration of ammonium ions leads to greatly reduced porosity even with shorter times and allows for greater conductivity of the chromating solution. A concentration range between 2 molar and saturation is preferred especially where high current densities are being used in the electrolytic process.

The ammonium ion may be introduced in a variety of ways including the addition of an ammonion salt such as ammonium chloride and the introduction of gaseous ammonia or ammonia solution. Particularly convenient is the addition of concentrated aqueous ammonia (generally about 15 molar concentration). A concentration range of approximately 10–50 milliliters concentrated aqueous ammonia per 100 milliliters of electrolytic solution yields quite good results. Although pH may be varied over wide limits, generally low pH particularly below pH of 7 is preferred because of higher conductivity of the electrolyte solution and reduced evaporation of ammonia from the solution. More rapid reduction in porosity and better corrosion resistance are also obtained at lower pH. The pH may be adjusted in a variety of ways including addition of acid (e.g., HC1, $H_2SO_4$, etc.) or base, etc. Buffering the solution may be advantageous in some cases.

The beneficial advantage of the inventive procedure are best demonstrated through porosity tests on the treated gold layers. The porosity test used is called the electrographic porosity test. This method involves use of an electrolytic indicator solution containing approximately 20 grams/liter of the disodium salt of dimethylglyoxime and 20 grams/liter of sodium chloride. Deionized water is generally used in making up this solution. A dye transfer paper (for example, type-F double weight dye transfer paper available from Eastman Kodak Company is also used). The dye transfer paper is shaped to fit on the surface being tested and then soaked in the electrolyte indicator solution for between 15 and 45 minutes. The surface being tested is cleaned (generally with an organic solvent) and then the soaked dye transfer paper is placed against the surface being tested. A cathode is then added and the assembly pressed together. The surface being tested is biased anodically with approximately 2 volts. The current is typically between 1 and 10 milliamps. The voltage is usually applied for approximately 60 seconds. Porosity is indicated by the number of spots (generally red for nickel base metal and green for copper base metal).

A specific example of the use of ammonium ions in the chromating process would be helpful in understanding the invention. Three circuit boards are used in the experiment. These circuit boards are designated as No. 1, No. 2, and No. 3. The fingers on these circuit boards have a gold layer over a copper base metal. Thickness of the gold layer averaged over approximately 16 fingers is approximately 160 microinches for No. 1, 133 microinches for No. 2, and 110 microinches for No. 3. Before treatment the porosity of the gold plating is measured by means of an electrographic porosity tester using dimethylglyoxime as the indicator. The porosity index is given a quantitative value by assigning various statistical weights to pore prints of a given size. These boards prior to treatment showed extremely high porosity. However, the electrographic porosity tester saturates at 40.0 and therefore the tester indicates porosity values of only 40.0.

Before chromating, the boards were chemically cleaned as follows:

1. Exposed to ethanol at 30° C for 5–10 minutes
2. Water rinse
3. Exposure to alkaline cleaner for 5 minutes
4. Hot water rinse
5. Exposure to an acid brightener for 4 minutes
6. Water rinse.

The circuit boards are then immediately placed in a chromating solution consisting of 5 weight percent potassium dichromate plus 30 volume percent concentrated ammonia. The fingers of the circuit boards are biased cathodically relative to a 4 inch square piece of platinized tantalum placed about 2 inches from the board. The current is cathodically brought up to 700 milliamps at a rate of approximately 20 milliamps per second. This current is roughly about 300 amperes/ft$^2$ and is maintained for approximately 30 minutes. After this procedure the board is rinsed for several minutes in water and dried in air at 70° C for several hours. The gold plated fingers often appear discolored.

The porosity of the three boards are again tested using the same procedure as outlined above. In each case the porosity is drastically reduced from a value in excess of 40.0 to an average value of 18.9 for board No. 1, 8.6 for board No. 2, and 12.1 for board No. 3. Also conductivity measurements show that the contact resistance of the gold plated fingers is not adversely affected by this procedure. These experiments demonstrate that thin porous gold platings can be rendered much less porous by the inventive procedure. Also this procedure does not adversely affect gold plating performance particularly as to electrical conductivity.

FIG. 1 shows a decorative article 10 which has been gold plated 11 and then treated in accordance with the invention. Such treatment results in low porosity even for quite thin gold platings which might be initially highly porous and subject to easy or rapid corrosion. This plating has low porosity with considerable corrosion protection.

Figure 2:
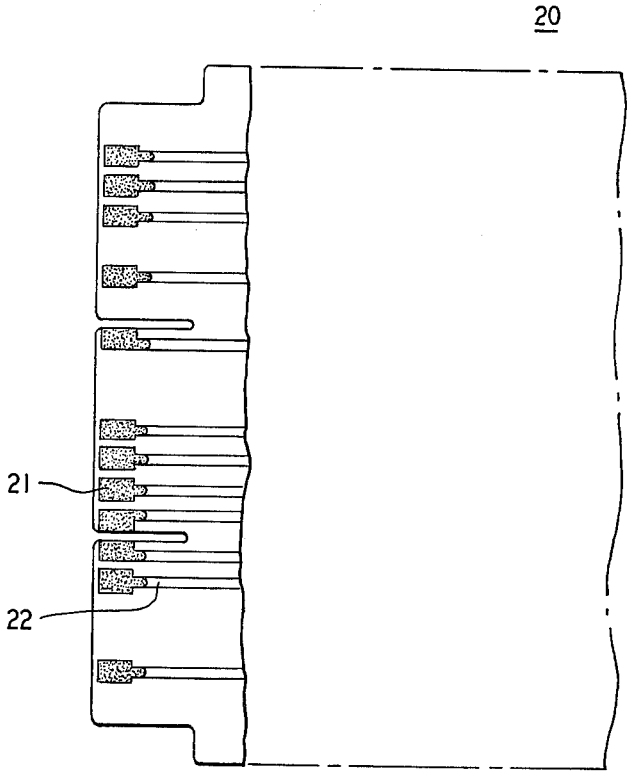
FIG. 2 is a top view of a circuit board showing contact fingers with modified gold plating made in accordance with the invention.

FIG. 2 shows a circuit board 20 with fingers 21 and conducting paths 22. The fingers have been gold plated and then treated in accordance with the invention.

What is claimed is:

1. A process for cathodically producing an article with at least one layer consisting essentially of at least 90 percent by weight of gold on a metallic surface consisting essentially of at least 50 weight percent of at least one metal selected from the group consisting of copper, nickel, tin, zinc and iron, said process comprising the step of passing current through an anode, aqueous solution and a cathode, with both cathode and anode at least partly immersed in the aqueous solution and in which said cathode includes the metallic surface with the layer characterized in that the aqueous solution comprises chromium-containing ions so as to decrease the porosity of the layer as evidenced by a decreased number of spots in an electrographic porosity test using dimethylglyoxime as the indicator, said aqueous solution and conditions capable of depositing chromium chemically combined with oxygen on the unlayered metallic surface.

2. The process of claim 1 in which the chromium containing ions are added to the aqueous solution as dichromate ions.

3. The process of claim 2 in which the aqueous solution contains between 1 and 10 grams of potassium dichromate per liter.

4. The process of claim 1 in which the procedure is carried out at a temperature between 45° and 95° C.

5. The process of claim 1 in which the gold layer is produced by an electroplating procedure.

6. The process of claim 1 in which the gold layer is produced by an electroless plating procedure.

7. The process of claim 1 in which the gold layer is produced by a vacuum vapor deposition procedure.

8. The process of claim 1 in which the current in terms of current density is between 50 and 800 amperes per square foot and the time of passing current is between 3 seconds and 90 minutes.

9. The process of claim 1 in which the aqueous solution contains ammonium ion in concentration of between 0.005 molar and saturation.

10. The process of claim 9 in which the concentration range is between 0.1 molar and saturation.

11. The process of claim 10 in which the concentration range is between 2 molar and saturation.

12. The process of claim 9 in which the pH is less than 7.

13. The process of claim 1 in which the metallic surface is plated on another surface.

14. The process of claim 1 in which the metallic surface consists essentially of a copper alloy.

15. The process of claim 1 in which the metallic surface consists essentially of copper.

* * * * *